US012077351B2

(12) United States Patent
Throup et al.

(10) Patent No.: US 12,077,351 B2
(45) Date of Patent: Sep. 3, 2024

(54) DOUBLE-WALLED CONTAINER

(71) Applicant: Multi Packaging Solutions UK Limited, Nottinghamshire (GB)

(72) Inventors: Richard Throup, Nottinghamshire (GB); Adam J. Troy, Nottinghamshire (GB)

(73) Assignee: Multi Packaging Solutions UK Limited (GB)

( * ) Notice: Subject to any disclaimer, the term of this patent is extended or adjusted under 35 U.S.C. 154(b) by 76 days.

(21) Appl. No.: 17/642,944

(22) PCT Filed: Sep. 11, 2020

(86) PCT No.: PCT/GB2020/052205
§ 371 (c)(1),
(2) Date: Mar. 14, 2022

(87) PCT Pub. No.: WO2021/048568
PCT Pub. Date: Mar. 18, 2021

(65) Prior Publication Data

US 2022/0363429 A1 Nov. 17, 2022

(30) Foreign Application Priority Data

Sep. 13, 2019 (GB) ..... 1913234

(51) Int. Cl.
*B65D 5/02* (2006.01)
*B65D 5/10* (2006.01)
(Continued)

(52) U.S. Cl.
CPC ..... *B65D 5/0281* (2013.01); *B65D 5/0227* (2013.01); *B65D 5/0254* (2013.01);
(Continued)

(58) Field of Classification Search
CPC .. B65D 5/0281; B65D 5/0227; B65D 5/0254; B65D 5/103; B65D 5/4266; B65D 5/443; B65D 5/5014; B65D 5/5016
(Continued)

(56) References Cited

U.S. PATENT DOCUMENTS 2,513,902 A * 7/1950 Tyrseck ..... B65D 5/58 206/521
3,133,634 A * 5/1964 Bulovic ..... B65D 5/4208 229/122

(Continued)

*Primary Examiner* — Christopher R Demeree
(74) *Attorney, Agent, or Firm* — Brian J. Goldberg; Rohini K. Garg

(57) ABSTRACT

A single piece container (200) made from cardboard, paperboard or other lightweight foldable sheet material is provided. The container (200) includes an outer shell and an inner shell. The outer shell has first and second ends (202, 204), and includes a plurality of outer shell sidewall panels (3, 5, 7, 9) hingedly connected to one other about respective outer shell sidewall foldlines. The outer shell sidewall panels (3, 5, 7, 9) extend between the first and second ends (202, 204) of the outer shell. At least the second end of the outer shell is a closed end. The inner shell includes a plurality of inner shell sidewall panels hingedly connected to one other about respective inner shell sidewall foldlines. The inner shell is integrally connected to the outer shell along a foldline. Each one of the inner shell sidewall panels is in face-to-face contact with the inner surface of a respective one of the outer shell sidewall panels (3, 5, 7, 9).

20 Claims, 7 Drawing Sheets

(51) Int. Cl.
*B65D 5/42* (2006.01)
*B65D 5/44* (2006.01)
*B65D 5/50* (2006.01)

(52) U.S. Cl.
CPC ..... *B65D 5/103* (2013.01); *B65D 5/4266* (2013.01); *B65D 5/443* (2013.01); *B65D 5/5014* (2013.01)

(58) Field of Classification Search
USPC ..... 229/122.32, 185.1, 125.125, 120.12, 229/120.18, 167; 206/45.25, 45.29; 493/89
See application file for complete search history.

(56) References Cited

U.S. PATENT DOCUMENTS 3,918,631 A * 11/1975 Hackenberg ..... B65D 5/0281 206/362
4,083,454 A * 4/1978 O'Neill ..... B65D 5/542 229/240
4,417,655 A * 11/1983 Forbes, Jr. ..... B65D 5/54 206/45.28
4,524,900 A * 6/1985 Salminen ..... B65D 5/38 229/210
4,524,901 A * 6/1985 Tikka ..... B65D 5/38 229/210
8,092,360 B2 * 1/2012 Greenfield ..... B65D 5/0281 493/93
8,899,414 B2 * 12/2014 Chatelain ..... B65D 5/38 229/125.125
10,322,844 B2 * 6/2019 Boersma ..... B31B 50/81

* cited by examiner

DOUBLE-WALLED CONTAINER

TECHNICAL FIELD

The present invention relates to containers made of cardboard, paperboard or other lightweight foldable sheet materials.

BACKGROUND

Containers made of cardboard, paperboard or other foldable sheet material may be made from a sheet material formed by laminating multiple layers of sheet material together.

A laminate construction may result in a container having greater strength, and able to hold heavier products. However, the need to laminate sheets of material together complicates the manufacture process for the container, and may add additional cost.

The Applicant has realised that there is a need for a container made of cardboard, paperboard or other flexible sheet material which may provide improved strength properties, but without the need to laminate layers of sheet material together.

SUMMARY

From a first aspect, the present invention provides a single piece container made from cardboard, paperboard or other lightweight foldable sheet material, the container comprising:

an outer shell having a first end and a second end, and comprising a plurality of outer shell sidewall panels hingedly connected to one other about respective outer shell sidewall foldlines, the outer shell sidewall panels extending between the first end and the second end of the outer shell, wherein at least the second end of the outer shell is a closed end;

an inner shell comprising a plurality of inner shell sidewall panels hingedly connected to one other about respective inner shell sidewall foldlines, wherein the inner shell is integrally connected to the outer shell along a foldline;

wherein each one of the inner shell sidewall panels is in face-to-face contact with the inner surface of a respective one of the outer shell sidewall panels.

Thus, in accordance with the invention, a single piece container having an outer shell and an inner shell is provided. The inner and outer shells are connected to one another along a foldline. Each one of the inner shell sidewall panels is in face-to-face contact with the inner surface of a respective one of the outer shell sidewall panels. In this way, the inner shell acts to reinforce the outer shell providing a two-ply wall thickness. This is achieved by folding a single piece blank, and avoids the need to laminate sheets of material to one another. Such a step may undesirably complicate manufacture, adding an initial stage to the process prior to erection of the container.

One of the inner shell sidewall panels is connected to one of the outer shell sidewall panels along a foldline. The foldline may be a foldline extending between the first and second ends of the outer shell. The foldlines connecting the panels of the outer shell, the panels of the inner shell, and the foldline connecting the inner and outer shells may all be parallel.

Those pairs of inner and outer shell sidewall panels which are in face-to-face contact may be in face-to-face contact over at least a portion or substantially the entirety of the facing surfaces thereof.

At least some of the pairs of inner and outer shell sidewall panels which are in face-to-face contact are preferably bonded to one another e.g. adhesively. However, it is not necessary that all of the pairs of inner and outer shell sidewall panels are necessarily bonded to one another. In some embodiments only some of the pairs of inner and outer shell sidewall panels are bonded to one another.

Each inner shell sidewall panel extends over at least a portion of the height of the outer shell sidewall panel with which it is in face-to-face contact, and preferably over at least 60%, or 70% or 80%, or substantially the entire height thereof.

In embodiments each inner shell sidewall panel extends over at least 80%, and optionally at least 90% or substantially the entire area of the outer shell sidewall panel with which it is in face to face contact.

Preferably the inner shell comprises N inner shell sidewall panels, and N−1 of the panels extend over the entire width and/or at least 90% of the area of the outer shell sidewall panel with which they are in face to face contact. The remaining inner shell sidewall panel may extend over at least 60%, or 70% of the width and/or area of the outer shell sidewall panel with which it is in face to face contact.

In some embodiments, each one of the inner shell sidewall panels extends over the entire width of the outer shell sidewall panel with which it is in face-to-face contact. In other embodiments only some of the inner shell sidewall panels extend over the entire width of the outer shell sidewall panels with which they are in face-to-face contact. In some embodiments a one of the inner shell sidewall panels adjacent the one of the inner shell sidewall panels which is connected along a foldline to one of the outer shell sidewall panels may extend over only a portion of the width of the outer shell sidewall panel with which it is in face-to-face contact e.g. at least 60%, or at least 70% or at least 75% of the width thereof. A distal edge of the inner shell sidewall panel which extends over only a portion of the width of the outer shell may be spaced from the foldline along which a one of the inner shell sidewall panels is connected to a one of the outer shell sidewall panels. Each other one of the inner shell sidewall panels may extend over the full width of the outer shell sidewall panel with which it is in face-to-face contact.

A one of the inner shell sidewall panels adjacent the one of the inner shell sidewall panels which is connected along a foldline to one of the outer shell sidewall panels may provide a glue flap.

Preferably one inner shell sidewall panel is provided in respect of each outer shell sidewall panel.

The outer shell may comprise first, second, third and fourth outer shell sidewall panels, wherein the first and second outer shell sidewall panels and the third and fourth outer shell sidewall panels form opposed pairs of outer shell sidewall panels. The inner shell may comprise first, second, third and fourth inner shell sidewall panels. The first inner shell sidewall panel may be in face-to-face contact with the first outer shell sidewall panel, the second inner shell sidewall panel may be in face-to-face contact with the second outer shell sidewall panel, the third inner shell sidewall panel may be in face-to-face contact with the third outer shell sidewall panel, and the fourth inner shell sidewall panel may be in face-to-face contact with the fourth outer shell sidewall panel.

The first and second inner shell sidewall panels, and the third and fourth inner shell sidewall panels may form opposed pairs of outer shell sidewall panels.

In some embodiments the first inner shell sidewall panel is bonded to the first outer shell sidewall panel and the third inner shell sidewall panel is bonded to the third outer shell sidewall panel. However, the second inner shell sidewall panel is optionally not bonded to the second outer shell sidewall panel and the fourth inner shell sidewall panel is optionally not bonded to the fourth outer shell sidewall panel.

The first outer shell sidewall panel may be connected to the fourth outer shell sidewall panel along a foldline. The fourth outer shell sidewall panel may be connected to the second outer shell sidewall panel along a foldline. The second outer shell sidewall panel may be connected to the third outer shell sidewall panel along a foldline.

The first inner shell sidewall panel may be connected to the fourth inner shell sidewall panel along a foldline. The fourth inner shell sidewall panel may be connected to the second inner shell sidewall panel along a foldline. The second inner shell sidewall panel may be connected to the third inner shell sidewall panel along a foldline.

In embodiments in which each of the inner and outer shells comprise first, second, third and fourth sidewall panels, a first inner shell sidewall panel may be connected along a foldline to the third outer shell sidewall panel.

The third inner shell sidewall panel may extend over only a portion of the width of the third outer shell sidewall panel. A distal edge of the third inner shell sidewall panel may be spaced from the foldline connecting the first inner shell sidewall panel to the third outer shell sidewall panel.

In embodiments the foldlines connecting the sidewalls of the inner shell to one another may comprise one or more, e.g. a plurality of cutlines along their length to facilitate folding of the inner shell. This may help the inner shell panels to lie close to the outer shell panels.

In embodiments, one of the outer shell sidewall panels is connected along one side along a foldline to an adjacent one of the outer shell sidewall panels, and comprises a flap connected thereto along a foldline along its opposite side, wherein the flap is bonded to one of the inner sidewall panels. The outer shell sidewall panel may be the first outer shell sidewall panel. In preferred embodiments the flap is sandwiched between the outer shell sidewall panel to which it is connected along a foldline and the inner shell sidewall panel which is in face-to-face contact with that outer shell sidewall panel. The flap is preferably a glue flap, although other bonding technologies e.g. heat sealing may be used. This location of the flap e.g. glue flap sandwiched between the outer shell sidewall panel and inner shell sidewall panel prevents a raw edge of material being visible to the end user of the final container and may also provide a neater overall appearance. The user is instead presented with a folded edge at the exterior of the container, provided by the foldline connecting the flap to the outer shell sidewall panel to which it is connected.

The terms base, upper, lower, above, below etc. are not intended to confer any limitation in relation to the orientation of the container in use, but are used merely to facilitate understanding of the position of features relative to one another. However, typically the base may define a lower end of the container for supporting a product located in the container in use.

The panels of the inner shell may each be of the same height, or may be of differing heights. The dimensions of the panels of the inner and outer shells will depend upon factors such as the configuration of a product with which the container is intended to be used. In some embodiments each one of the inner sidewall panels is of the same height. In embodiments each one of the outer shell sidewall panels is of the same height. The height refers to the maximum dimension of a panel along the direction connecting the first and second ends of the container.

The shape of the panels of the inner and outer shells may be selected as desired. The most appropriate shape of the sidewall panels will depend upon the configuration of a product with which the container is intended to be used. In some embodiments, each of the end edges of each one of the inner and/or outer shell sidewall panels may be straight. For example, the panels may each be of a square or rectangular shape. The end edges of the panels refer to those edges closest to the first and second ends of the outer shell respectively. The dimension of the panels along the direction in which these edges extend may define a width of the panel.

The outer shell sidewall panels are preferably continuous walls. This will enable the sidewalls of the outer shell to fully surround a product located therein.

The container has first and second ends, which may be defined by the first and second ends of the outer shell.

The outer shell may comprise any suitable number of sidewall panels, depending upon the desired shape and configuration of the container. In some embodiments the outer shell has four sidewall panels, although a greater or lesser number of sidewall panels may be used. The inner shell preferably has the same number of sidewall panels as the outer shell e.g. four. The first and second ends of the outer shell may provide the first and second ends of the container. The second end of the outer shell is a closed end, and may provide a base of the outer shell. The second end of the outer shell may provide a base of the container.

The container may be a square or rectangular container, although other configurations may be envisaged e.g. hexagonal, octagonal etc. The shape of the container will be defined by the shape of the outer shell, which may therefore be of any such shapes. In some embodiments the sidewall panels of the outer shell and/or inner shell are rectilinear e.g. square or rectangular. It is not necessary that the inner sidewall panels are rectilinear. For example, one or both ends of at least some of the panels may be curved, or have a shape to help support a product located in the container.

The outer shell comprises a plurality of pairs, e.g. two or more pairs, of opposed sidewall panels. First and second, and third and fourth outer shell sidewall panels may provide respective first and second pairs of opposed sidewall panels of the outer shell.

In embodiments first and second, and third and fourth inner shell sidewall panels provide respective first and second pairs of opposed inner shell sidewall panels.

The panels of each pair of opposed sidewall panels, whether outer shell or inner shell sidewall panels, preferably extend parallel to one another.

At least the second end of the opposed first and second ends of the outer shell is a closed end. The second end may provide a closed base of the outer shell and hence container. Any suitable closure structure may be used e.g. a lid structure or end panel as described below. The second end may or may not be bonded (e.g. using adhesive or heat sealing) in its closed configuration. In preferred embodiments the second end is not bonded in its closed configuration.

The second end may comprise a set of base flaps which may be used to provide a closed base. The base flaps preferably interlock to provide the closed base.

In some embodiments one or more of the outer shell sidewall panels comprise a base flap connected to a second end thereof for use in providing a closed base at the second end of the outer shell. Each base flap is connected along a foldline to its respective outer shell sidewall panel. The number of outer shell sidewall panels which include such flaps will depend upon the construction of the base. In some embodiments in which first, second, third and fourth outer shell sidewall panels are provided, at least the three of the outer shell sidewall panels e.g. the second, third, and fourth outer shell sidewall panels comprise such base flaps.

In some sets of embodiments the container comprises a base flap connected to one of the outer shell sidewall panels along a foldline at the second end thereof, the base flap comprising a base panel and a closure flap connected to a distal end of the base panel, wherein the base flap is folded over base flaps connected to adjacent ones of the outer shell sidewall panels along respective foldlines at the second ends thereof, and the closure flap tucked between the edges of the base flaps connected to the adjacent outer shell sidewall panels and the edge of the outer shell sidewall opposite that to which the base flap comprising the base panel and closure flap is connected to close the base.

In other embodiments the outer shell comprises first, second, third and fourth outer shell sidewall panels, which each comprise base flaps. This may enable a so-called "envelope base" to be obtained.

In embodiments, the outer shell comprises first, second, third and fourth outer shell sidewall panels, and each one of the first, second, third and fourth outer shell sidewall panels comprises a base flap connected to the second end thereof along a foldline to provide a set of base flaps, the base flaps including;

- a first base flap connected along a foldline to one of the sidewalls;
- second and third opposed base flaps connected along respective foldlines to respective ones of the sidewalls adjacent the sidewall to which the first base flap is connected on either side thereof, wherein the second and third base flaps are folded over the first base flap;
- and a fourth base flap connected along a foldline to a sidewall opposite the sidewall to which the first base flap is connected, wherein the fourth base flap is folded over the second and third base flaps;
- wherein the fourth base flap comprises a base panel portion which forms part of the exterior of the base and a locking tab portion connected to a distal end of the base panel portion, wherein the locking tab portion of the fourth base flap is inserted through a slot is defined by the first, second and third base flaps into the interior of the container to retain the base in a closed configuration.

The above type of base is known as an "envelope base".

The slot is defined by respective portions of the first, second and third base flaps. The second and third base flaps may each comprise a proximal portion and a distal portion. The slot through which the locking tab portion of the fourth base flap is inserted may be defined by an edge region of the distal portion of each one of the second and third base flaps and an edge defined by the first base flap. The edge regions of the distal portion of the second and third base portions may provide an edge of the slot. The inner edges of the distal portions of the second and third base flaps may be spaced from one another. Thus, there may be a discontinuity along an edge of the slot provided by the edge regions of the distal portions of the second and third base flaps.

The slot may be defined by abutting edges defined by the first, second and third base flaps (e.g. the distal portions of the second and third base flaps), or by an edge defined by the first base flap and underlying surfaces of the second and third base flaps e.g. of the distal portions thereof.

The slot may be defined by an edge region of the distal portion of each one of the second and third base flaps and an edge defined by the first base flap. The first base flap may comprise a recess formed in a distal end thereof, wherein the portion of the distal edge of the first base flap defining a proximal end of the recess provides the edge of the first base flap which cooperates with the edge regions of the second and third base flaps to define the slot through which the locking tab portion of the fourth base flap is inserted.

The locking tab portion of the fourth base flap refers to that portion which is tucked through the slot into the interior of the container. In embodiments there is no identifiable distinction between the locking tab portion and base panel portion of the fourth base flap. Thus the transition may be a smooth transition. The base panel portion of the fourth base flap and the locking tab portion thereof may be continuous with one another. Preferably no foldline is provided between the base panel portion and locking tab portion. It has been found that this may reduce the likelihood of the locking tab portion starting to move out of the slot.

The side edges of the base panel portion of the fourth base flap preferably converge with one another in the direction toward a distal end of the base panel portion. The side edges may be straight. In some embodiments the base panel portion of the fourth base flap is generally trapezoidal in shape.

The locking tab portion of the fourth base flap may be of any desired shape. In embodiments the locking tab portion comprises a pair of side edges separated by a distal end edge. The side edges are preferably curved. The distal end edge is preferably straight. This may assist with insertion of the locking tab portion through the slot defined by the first, second and third flaps as described herein.

The fourth base flap has a portion located inside the container i.e. the locking tab portion, and a portion located outside the container i.e. the base panel portion. The base panel portion defines a portion of the exterior of the base. At least a portion of each of the first, second and third base flaps also define respective portions of the exterior of the base. The exterior portions of the base provided by each of the second and third flaps may be generally triangular in shape. The exterior portion of the base provided by the first flap may be generally trapezoidal in shape.

It will be appreciated that references to a portion of a base flap defining a portion of the exterior of the base should be understood as referring to the portion of the base flap defining a portion of the exterior of the base structure as described herein. Arrangements in which the base structure is covered in some way by another component would not be excluded.

In some embodiments the first base flap comprises a recess formed in a distal end thereof, wherein a portion of the distal edge of the first base flap defining a proximal end of the recess provides the edge of the first base flap which cooperates with the edge regions of the distal portions of the second and third base flaps to define the slot through which the locking tab portion of the fourth base flap is inserted.

The first base flap may comprise distal end portions on either side of the recess. In preferred embodiments an inner edge region of each distal end portion of the first base flap defines a hook.

In some embodiments the distal portions of each of the second and third base flaps define hooks. The hooks may be tucked behind a slot defining edge of the first base flap.

In other embodiments it is envisaged that the first base flap may comprise an opening, an edge of which provides the edge which defines the slot together with the second and third base flaps.

In some embodiments in which the outer shell comprises first, second, third and fourth outer shell sidewall panels, wherein the first and second outer shell sidewall panels and the third and fourth outer shell sidewall panels form opposed pairs of outer shell sidewall panels, the first, second, third and fourth base flaps may be associated with the second, third, fourth and first outer shell sidewall panels respectively.

In embodiments, regardless of the construction of the base, one or more of the inner shell sidewall panels comprise a reinforcement flap connected to a second end thereof along a foldline, which reinforcement flap is arranged to underlie one of the base flaps of the outer shell to reinforce the outer shell base flap. Each reinforcement flap will underlie the base flap of a one of the outer shell sidewalls with which the respective inner shell sidewall is in facing relationship. In embodiments at least two of the inner sidewall panels comprise such a reinforcement flap.

The reinforcement flap connected to one of the inner sidewall panels extends over a portion, and optionally only a portion, of the area of the outer shell base flap which it reinforces. This may ensure that the reinforcement flap remains within the outer contour of the associated base flap. The reinforcement flap may be of the same, or different shape to the outer shell base flap.

Preferably the reinforcement flap is unsecured to its outer shell base flap.

Such arrangements are particularly advantageous in the context of an envelope type base.

In embodiments, the outer shell comprises first, second, third and fourth outer shell sidewall panels, and each one of the first, second, third and fourth outer shell sidewall panels comprises a base flap connected to the second end thereof along a foldline to provide a set of base flaps, the base flaps including;

- a first base flap connected along a foldline to one of the sidewalls;
- second and third opposed base flaps connected along respective foldlines to respective ones of the sidewalls adjacent the sidewall to which the first base flap is connected on either side thereof, wherein the second and third base flaps are folded over the first base flap;
- and a fourth base flap connected along a foldline to a sidewall opposite the sidewall to which the first base flap is connected, wherein the fourth base flap is folded over the second and third base flaps;
- wherein the fourth base flap comprises a base panel portion which forms part of the exterior of the base and a locking tab portion connected to a distal end of the base panel portion, wherein the locking tab portion of the fourth base flap is inserted through the slot defined by the first, second and third base flaps into the interior of the container to retain the base in a closed configuration.

Preferably one or more of the inner sidewall panels, and optionally a plurality of the inner sidewall panels, comprises a reinforcement flap connected to a second end thereof along a foldline, which reinforcement flap is arranged to underlie one of the base flaps of the outer shell to reinforce the outer shell base flap.

Preferably reinforcement flaps are provided for at least, and optionally only, for the first and fourth base flaps.

Each reinforcement flap will underlie the base flap of a one of the outer shell sidewalls with which the respective inner shell sidewall is in facing relationship. In embodiments in which the inner shell comprises first, second, third and fourth outer shell sidewall panels, and the first and second outer shell sidewall panels and third and fourth inner shell sidewall panels form opposed pairs of inner shell sidewall panels, preferably at least the first and second inner sidewall panels comprise reinforcement flaps.

In general, reinforcement flaps are preferably provided at least, and optionally only, for the first and fourth base flaps.

The Applicant has realised that providing reinforcing base flaps associated with the inner sidewall panels may enable portions of the sheet from which a blank for providing the container is cut to be utilised to obtain a stronger base for the container, which sheet portions would otherwise be wasted. Particular benefits may be associated with using reinforcing base flaps in the context of an envelope base, which is a relatively strong base construction in its own right.

It is believed that such arrangements are advantageous in their own right in the context of an envelope type base.

From a further aspect of the present invention there is provided;

a container made from cardboard, paperboard or other lightweight foldable sheet material, the container comprising:

- first, second, third and fourth sidewall panels hingedly connected to one other about respective foldlines, the sidewall panels extending between first and second ends of the container,
- wherein each one of the first, second, third and fourth sidewall panels comprises a base flap connected to the second end thereof along a foldline to provide a set of base flaps, the base flaps including;
- a first base flap connected along a foldline to one of the sidewalls;
- second and third opposed base flaps connected along respective foldlines to respective ones of the sidewalls adjacent the sidewall to which the first base flap is connected on either side thereof, wherein the second and third base flaps are folded over the first base flap;
- and a fourth base flap connected along a foldline to a sidewall opposite the sidewall to which the first base flap is connected, wherein the fourth base flap is folded over the second and third base flaps;
- wherein the fourth base flap comprises a base panel portion which forms part of the exterior of the base and a locking tab portion connected to a distal end of the base panel portion, wherein the locking tab portion of the fourth base flap is inserted through the slot defined by the first, second and third base flaps into the interior of the container to retain the base in a closed configuration;
- wherein the container comprises a reinforcement flap in respect of each of one or more of the base flaps, the reinforcement flap being arranged to underlie a respective one of the base flaps to reinforce the base flap.

The present invention in this further aspect may include any or all of the features described in relation to the earlier aspects or embodiments of the invention.

The container may be a single piece container.

The container may be erected from a single piece blank.

In embodiments the first, second, third and fourth sidewalls form an outer shell of the container, and the container further comprises an inner shell comprising a plurality of sidewall panels hingedly connected to one another along respective foldlines, and the reinforcement flaps are connected along foldlines to the second ends of respective ones of the sidewall panels of the inner shell. It will be appreciated that in these broader aspects, the panels of the inner shell need not necessarily be in face-to-face contact with panels of the outer shell. However, in embodiments, at least those ones of the sidewalls of the inner shell having reinforcement flaps connected thereto are in face-to-face contact with respective ones of the outer shell sidewall panels. This may facilitate positioning of the reinforcement flaps in close proximity to the outer shell base flaps.

In these further aspects, the inner shell may be integrally connected to the outer shell along a foldline.

In these further aspects or embodiments, the reinforcing base flaps may be provided in any suitable manner, provided that they are located so as to underlie i.e. be inward of respective ones of the base flaps.

In any of the aspects or embodiments of the invention in which reinforcement flaps are provided, preferably reinforcement flaps are preferably provided at least, and optionally only, for the first and fourth base flaps.

In any of the aspects or embodiments having reinforcement flaps, preferably each reinforcement flap extends over a portion, and optionally only a portion, of the area of the base flap which it reinforces. This may ensure that the reinforcement flap remains within the outer contour of the associated base flap. The reinforcement flap may be of the same, or different shape to the base flap. For example, where the distal end of the first base flap comprises a recess, a reinforcement flap in respect of the first base flap may only cover a portion of the flap proximal to an edge of a recess therein.

Preferably the reinforcement flap is unsecured to its base flap. In these embodiments the reinforcement flap is unbonded to the base flap e.g. by adhesive or any other form of attachment.

Each reinforcement flap is in a facing relationship with its respective base flap, and is preferably in face-to-face contact with its respective base flap. The outer surface of the reinforcement flap faces, or preferably is in contact with the inner surface of the base flap.

The container of the invention in any of its aspects or embodiments may further comprise any suitable closure structure at the first end thereof. For example, a lid structure may be provided, which may be of the same type used in certain embodiments in respect of the second end of the container. The lid structure may provide a releasable and refastenable closure. The lid, may, if desired, incorporate a suitable product support structure.

In embodiments first end of the container may be the end through which a product located in the container is intended to be initially viewed or withdrawn in use (the end through which a product is withdrawn may depend upon the shape of the product and any cooperating product support features). This end may be referred to as the "top" end of the container, although this does not imply any required orientation of the container in use. The first or "top" end refers to the end opposite to the second or bottom end of the outer shell (or container) which may define a base for the container. However, it will be appreciated that this again does not imply any particular orientation of the container in use, and terms such as "top", "bottom", and base are used merely to distinguish the ends of the container/inner shell/outer shell from one another for the purposes of illustrating certain features of the invention.

The first end of the outer shell may be a closed end. As with the second end, the first end of the container may or may not then be bonded in its closed configuration. Any suitable end closure structure may be used. Generally the end closure may comprise an end panel or lid panel and a pair of end flaps underlying the end panel or lid panel.

It will be appreciated that any combination of bonded and releasable closures may be used at the ends of the container e.g. a releasable and refastenable lid structure at the first end and a bonded closure at the second end. Where a bonded closure is provided at either end of the outer shell, a refastenable closure feature may be provided in respect of that end. It is also envisaged that the first end may be an open end, with no closure feature.

The container of the present invention may be used to receive any type of product. The product is located within the inner shell in use. The present invention extends to a container in accordance with the invention in any of its aspects or embodiments having a product located therein. The product may be a container, e.g. a bottle, such as a drinks bottle. However this is only one example of the type of product which may be held by the container. The container is particularly useful in conjunction with fragile products where it is desired to protect the product from impact. Product may be loaded into the inner shell from either end, depending upon the configuration of any product support features, with the applicable end of the outer shell then being closed.

The container may include any suitable features to assist in supporting a product in the container.

The present invention extends to a blank for providing the container in accordance with any of the embodiments herein described. The blank is a single piece blank.

In accordance with a further aspect of the invention there is provided a single piece blank made from cardboard, paperboard or other lightweight foldable sheet material, the blank being erectable to provide a container in accordance with any one of the embodiments described herein.

In accordance with the invention in any of its aspects or embodiments, the container is made from a foldable sheet material such as paperboard or cardboard, or even a plastics material. The material may be chosen as desired. Preferably the material is a non-plastics material.

In accordance with the invention in any of its aspects or embodiments, the container may be made of cardboard, paperboard or other lightweight foldable sheet material.

A fold line as referred to herein refers to any line about which components have been folded. The fold line may comprise a line of weakness, crease line and/or perforations. If not explicitly stated, and unless inconsistent therewith, any connection described herein may be about a fold line.

Any reference to a height refers to a dimension as measured in the direction extending between the first and second ends of the outer shell (or inner shell or container as appropriate). A width of a sidewall panel is measured in the direction connecting the opposed edges of the sidewall panel. The width dimension may be measured in a direction perpendicular to a direction connecting the first and second ends of the outer shell/container.

The term "at least some" refers to one or more.

Where panels are described as being in face-to-face contact, the panels are in face-to-face contact over at least a portion, and optionally the entire area of their facing surfaces, unless the context demands otherwise.

The present invention in accordance with any of its further aspects or embodiments may include any of the features described in reference to other aspects or embodiments of the invention to the extent it is not mutually inconsistent therewith.

BRIEF DESCRIPTION OF DRAWINGS

Some preferred embodiments of the invention will now be described by way of example only and with reference to the followings drawings, of which.

DETAILED DESCRIPTION

Figure 1:
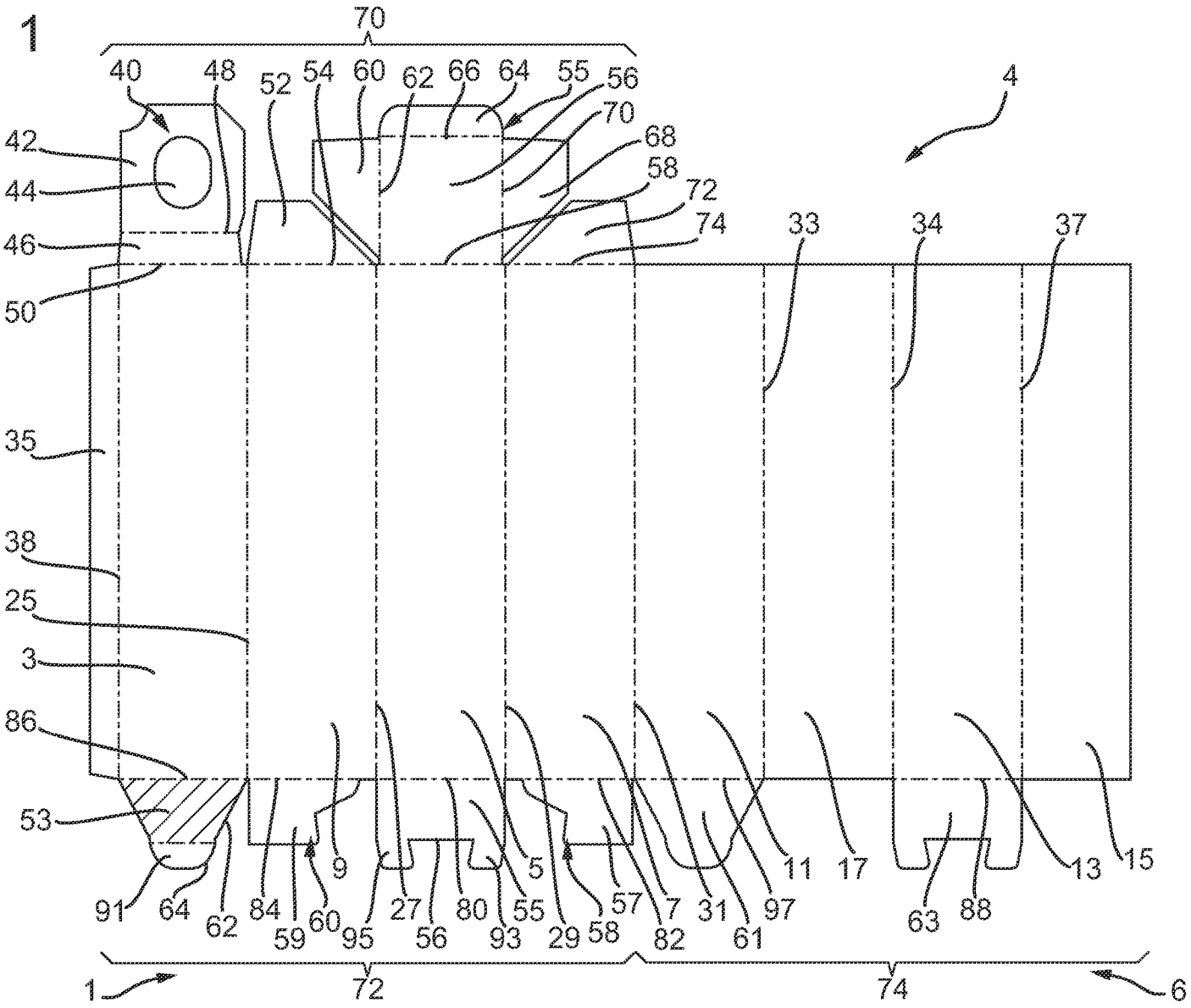
FIG. 1 shows a blank in the flat for forming a container in accordance with a first embodiment of the present invention.

With reference to FIG. 1, a blank for providing a container in accordance with a first embodiment of the invention will now be described.

FIG. 1 shows the blank in the flat from above, from the side which will provide portions of the exterior surface of the erected container.

The blank has a first end 4 which provides a first end of the container when erected, and a second end 6 which provides a second end of the container when erected. The second end of the container is a base of the container.

The blank 1 includes an outer shell sub-assembly 72 for providing an outer shell and associated components of the container, and an inner sub-assembly 74 for providing an inner shell and associated components of the container.

The outer shell sub-assembly 72 includes a first outer shell sidewall panel 3, a second outer shell sidewall panel 5, a third outer shell sidewall panel 7, and a fourth outer shell sidewall panel 9. The first and fourth outer shell sidewall panels 3, 9 are connected by a foldline 25. The second and fourth outer shell sidewall panels 5, 9 are connected by a foldline 27. The second and third outer shell sidewall panels are connected by a foldline 29.

A glue flap 35 is connected along a foldline 38 to the first outer shell sidewall panel 3.

An array of flaps 70 is connected to the first ends of the first, second, third and fourth outer shell sidewall panels 3, 5, 7, 9 for forming a closed lid structure at the first end of the container erected from the blank. The flaps include a first lid flap 55 connected along a foldline 58 to the second outer shell sidewall panel 5, second and third lid flaps 72, 52 connected to the third and fourth outer shell sidewalls 7, 9 respectively along foldlines 74, 54, and a product support flap 40 connected along a foldline 50 to the first end of the first outer shell sidewall panel 3.

The first lid flap 55 includes a lid panel 56 and first and second side flaps 60, 68 connected along respective foldlines 62, 70 to the side edges of the lid flap 56. A closure flap 64 is connected along a foldline 66 to the distal end of the lid panel 56.

The product support flap 40 includes a proximal portion 46 and a distal portion 42 connected along a foldline 48 thereto. The proximal portion 46 is connected along a foldline 50 to the first end of the first outer shell sidewall panel 3. The distal portion 42 of the product support flap 40 includes an opening 44.

A first base flap 55, is connected to the second end of the second outer shell sidewall panel 5 along a foldline 80. The distal end of the first base flap 55 defines a recess. The proximal end of the recess is provided by an edge 56. The first base flap 55 has distal portions defining hooks 93, 95 on either side of the recess.

A second base flap 57 is connected to the second end of the third outer shell sidewall panel 7 along a foldline 82. A third base flap 59 is connected to the second end of the fourth outer shell sidewall panel 9 along a foldline 84, and a fourth outer shell base flap 53 is connected along a foldline 86 to the second end of the first outer shell sidewall panel 3. These base flaps may be used to provide an envelope type base closure. It will be seen that the distal portions of the second and third base flaps 57, 59 define hooks 58, 60 respectively. The fourth base flap 53 has a distal end portion 91.

As described below, in the closed base, the hooks 58, 60 of the second and third base flaps 57, 59 engage behind the edge 56, and the distal portions of the second and third base flaps 57, 59 and the edge 56 define a slot through which the distal end portion 91 of the fourth base flap 53 is inserted into the interior of the container. The fourth base flap 53 defines a base panel portion 62 and a locking tab portion 64. The base panel portion 62 forms part of the exterior of the base in the erected container, while the locking tab portion 64 is located to the interior of the base. The base panel portion is denoted in hatched lines. However, this is merely to facilitate understanding of the arrangement. It will be appreciated that there is preferably no foldline or other feature distinguishing the portions of the fourth base flap 53 from one another.

The inner shell sub-assembly 74 includes a first inner sidewall panel 11, which is connected to the third outer shell sidewall panel 7 along a foldline 31.

The inner shell sub-assembly 74 also includes a fourth inner shell sidewall panel 17 connected to the first inner shell sidewall panel 11 along the foldline 22, a second inner shell sidewall panel 13 connected to the fourth inner shell sidewall panel 17 along a foldline 34, and a third inner shell sidewall panel 15 connected to the second inner shell sidewall panel 13 along a foldline 37.

The foldlines 33, 34, 37 connecting the sidewalls of the inner shell may comprise one or more, e.g. a plurality of cutlines along their length to facilitate folding of the inner shell. This may help the inner shell panels to lie close to the outer shell panels.

A first base reinforcement flap 63 is connected to the second end of the second inner shell sidewall panel 13 along a foldline 88, and lies inside the first base flap 55 to reinforce the base flap 55 when the base is closed. The first base reinforcement flap 63 has a smaller area than the first base flap 55, so as to fit within the outer contour of the portion of the first base flap proximal to the recess of the first base flap 55.

A second base reinforcement flap 61 is connected to the second end of the first inner shell sidewall panel 11 along a foldline 97, and lies inside the fourth base flap 53 to reinforce the base flap 53 when the base is closed. The second base reinforcement flap 61 has the same shape as the fourth base flap 53, but a smaller area, so as to lie within the outer contour of the fourth base flap 53.

One way in which the blank 1 may be used to provide a container will now be described by reference to FIGS. 2A-H and 3A-C.

Figure 2A:
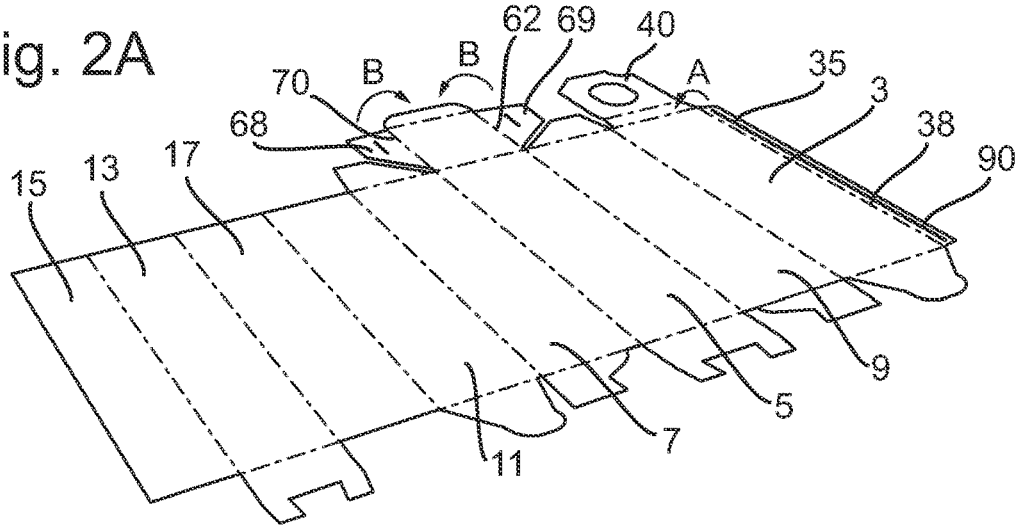
FIG. 2A illustrates the blank of FIG. 1 after an initial folding and gluing step in a flat configuration.

FIG. 2A illustrates the blank in the flat from above, with the surface which will be located to the interior of the container uppermost i.e. the opposite surface to that which is uppermost in FIG. 1.

Figure 2B:
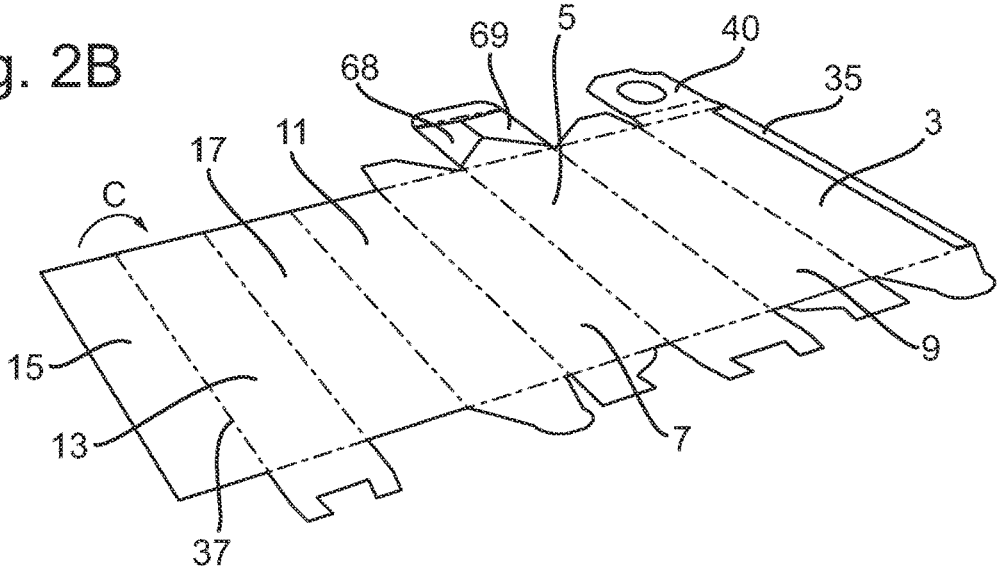
FIG. 2B illustrates the blank of FIG. 2A after a first folding and gluing step in a flat configuration.
Figure 2C:
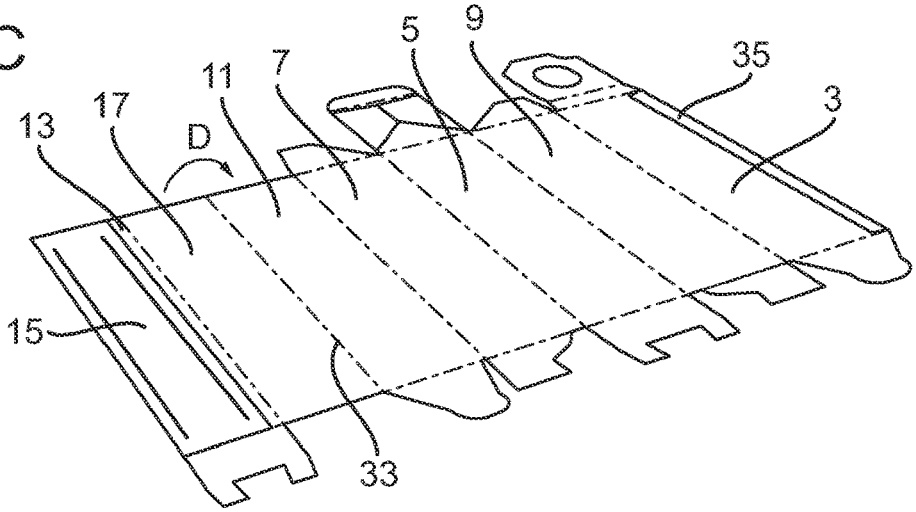
FIG. 2C illustrates the blank of FIG. 2B after a second folding and gluing step in a flat configuration.

In a first step, glue is applied to the interior surface of the glue flap 35 and to the interior surfaces of the first and second lid side flaps 60, 68. In the embodiment illustrated a glue line is applied to the surface of each flap 35, 60, 68. However, any suitable glue pattern may be used. The glue flap 35 is folded in the direction of the arrow A shown in FIG. 2A along the foldline 38 connecting the flap 35 to the first outer shell sidewall panel 3. The lid side flaps 60, 68 are folded along the foldlines 62, 70 connecting them to the lid panel 56 in the direction of the arrows B in FIG. 2A. This provides a folded blank as shown in FIG. 2B. The glue flap 35 is adhered to the inner surface of the first outer shell sidewall panel 3, and the lid side flaps 60, 68 are adhered to the inner surface of the lid panel 56. In this way, the lid side flaps 60, 68 reinforce the lid panel 56.

In step 2, the blank is folded in the direction of the arrow C about foldline 37 so as to fold the third inner shell sidewall panel 15 onto the inner surface of the second inner shell sidewall panel 13. This provides the folded blank shown in FIG. 2C.

Figure 2D:
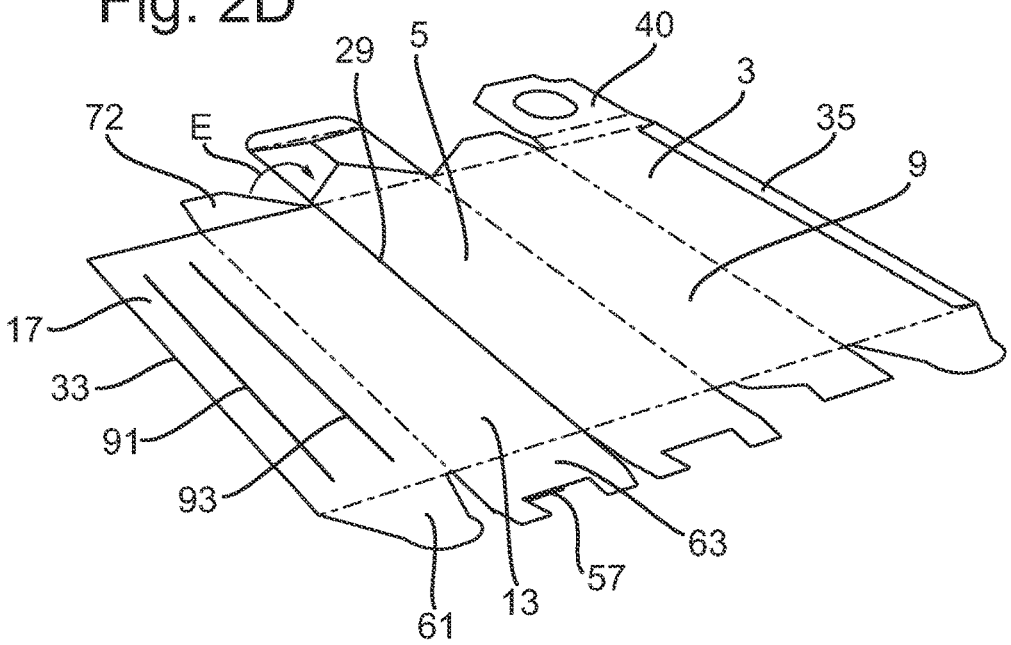
FIG. 2D illustrates the blank of FIG. 2C after a third folding and gluing step in a flat configuration.
Figure 2E:
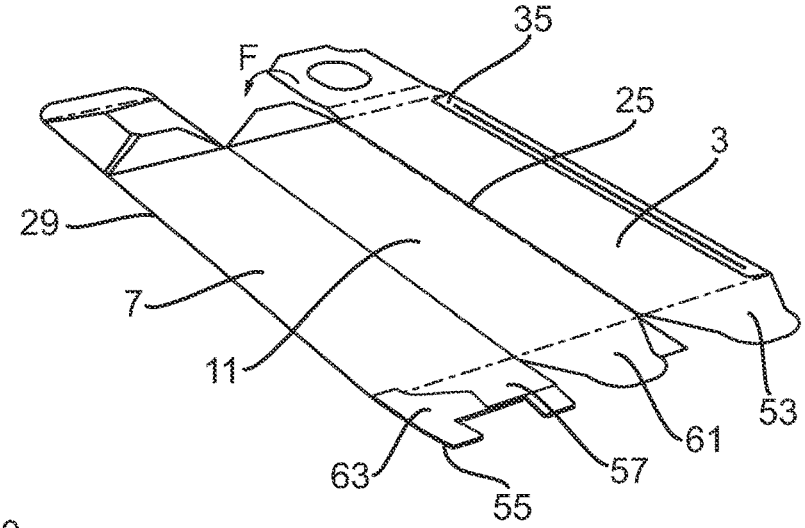
FIG. 2E illustrates the blank of FIG. 2D after a fourth folding and gluing step in a flat configuration.

In step 3 glue is applied to the outer surface of the third inner shell sidewall panel 15. In the illustrated embodiment a pair of parallel glue lines is used. This may result in improved strength in the resulting container. However, other glue patterns e.g. a single central glue line may be used. The blank is then folded in the direction of arrow D about the foldline 33 between the fourth inner shell sidewall panel and the first inner shell sidewall panel 11 to provide a folded blank as shown in FIG. 2D.

In step 4, glue is applied to the outer surface of the fourth inner shell sidewall panel 17. In the illustrated embodiment a pair of parallel glue lines is used. This may result in improved strength in the resulting container. However, other glue patterns e.g. a single central glue line may be used. The blank is then folded in the direction of the arrow E about the foldline 29 connecting the second and third outer shell sidewall panels to provide the folded blank shown in FIG. 2E.

In step 5, glue is applied to the uppermost surface of the glue flap 35. The blank is then folded about the foldline 25 connecting the first and fourth outer shell sidewall panels 3, 9 to provide the folded blank shown in FIG. 2F. The glue flap 35 is adhered to the outer surface of the first outer shell sidewall panel 3.

Figure 2F:
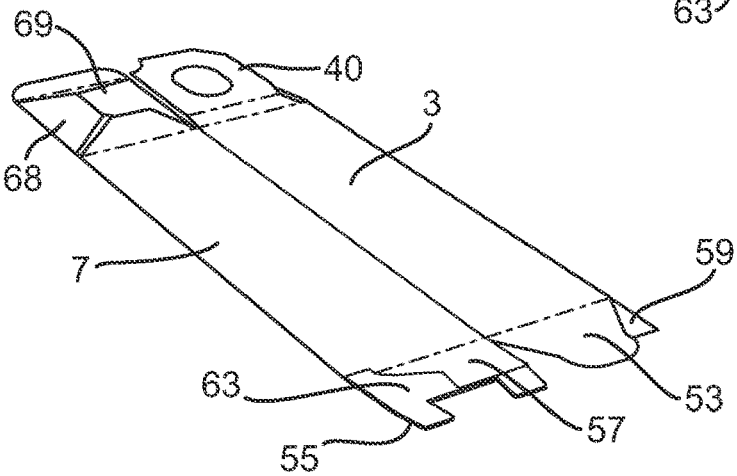
FIG. 2F illustrates the blank of FIG. 2E after a fifth folding and gluing step in a flat configuration.
Figure 2G:
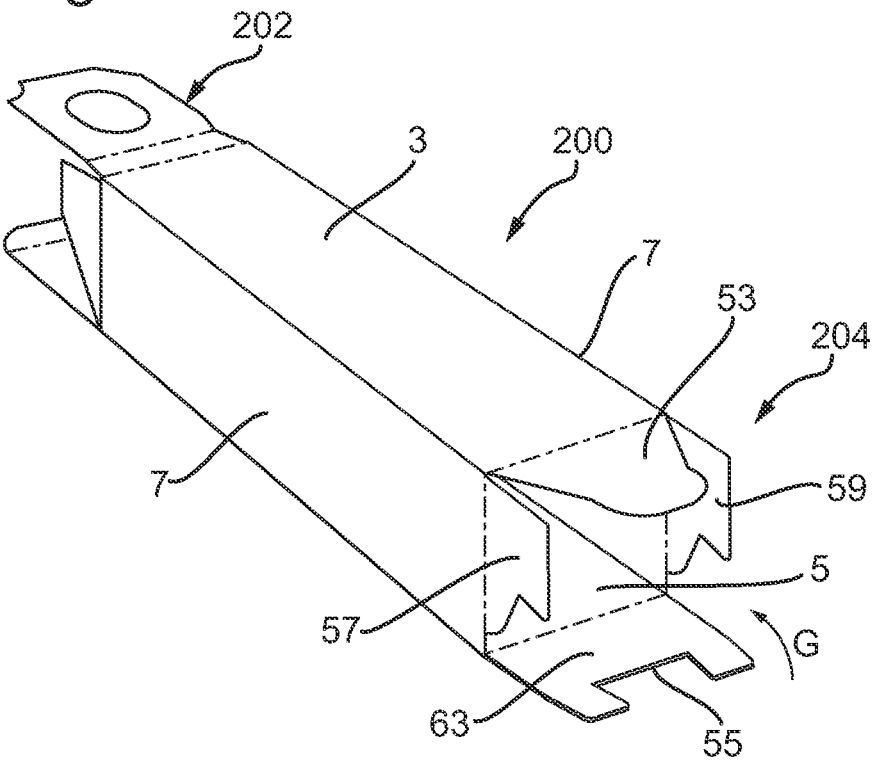
FIG. 2G illustrates the blank of FIG. 2F after a sixth step to erect the blank into a 3-dimensional state, with both ends in an open configuration'

In step 6, the folded and glued blank is caused to change from the flat configuration shown in FIG. 2F to a 3-dimensional configuration as shown in FIG. 2G. The erected container is referred to as 200. This may occur at a different time and place to steps 2A-F if required. Thus, the folded, glued blank may be supplied in the form shown in FIG. 2F for final erection. Conversion of the flat folded and glued blank shown in FIG. 2F to the configuration shown in FIG. 2G may be achieved by applying suction to the surface lying uppermost in FIG. 2F, or by urging the sides of the folded blank inwardly, or in any suitable manner.

After step 2G, the first and second ends of the container 202, 204, provided by the first and second ends 4, 6 of the blank respectively are open.

Figure 2H:
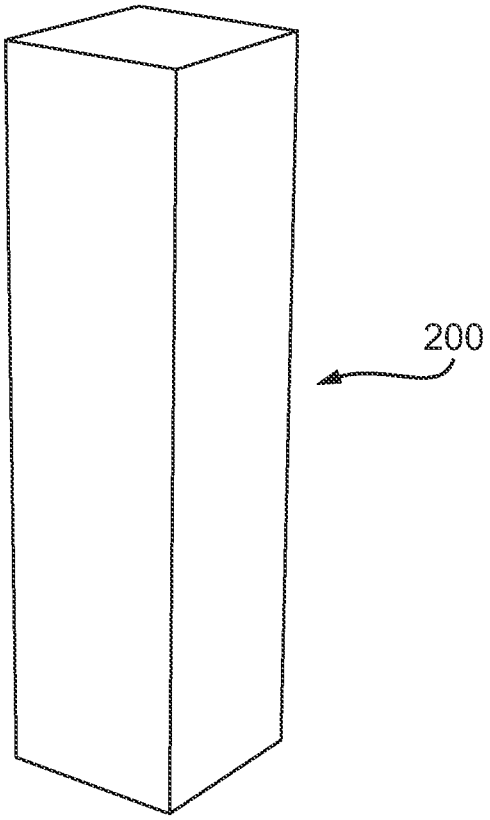
FIG. 2H illustrates a container obtained after a seventh step to close the first and second ends of the erected blank of FIG. 2G.

In a final step 7, the first and second ends of the container are closed to provide the container 200 with closed first and second ends as shown in FIG. 2H. The manner in which the base flaps associated with the second end of the container are used to close the base will be described in more detail below by reference to FIGS. 3A-C. The lid and base may be closed in any order, sequentially or simultaneously. A product is inserted in the container before both ends are closed. Typically the base is closed, the product inserted, and the first end then closed, although other options may be envisaged.

The first end of the container is closed in by folding the product support flap into the interior of the container, and bending the product support flap about the foldline 48, such that the proximal portion 46 extends along the interior of the first outer shell sidewall panel 3, and the distal portion 42 extends substantially perpendicular thereto toward the second inner shell sidewall panel 13. The opening 44 may then be used to support the neck of a bottle located in the container in use. The second and third lid flaps 72, 52 are then rotated 90 degrees from the position shown in FIG. 2G toward the interior of the container, and the reinforced lid panel 56 is folded thereover, with the closure flap 64 tucked between the proximal portion 46 of the first lid flap 40 and the side edges of the second and third lid flaps 72, 52.

The configuration of the lid structure at the first end of the container illustrated is merely exemplary. Different configurations of lid may be used, depending e.g. upon the nature and configuration of a product to be included in the container. For example, the product support flap 40 may be omitted. The side flaps extending from the lid panel 56 may be omitted, in which case the shape of the second and third lid flaps 52, 72 may be altered. In yet other embodiments, the first end of the container may be left open, and not include a lid structure. Rather than providing a releasable and refastenable closure as shown, the lid may be bonded in a closed configuration.

One way in which the base may be closed will now be described by reference to FIGS. 3A-C. The first end is shown as open in these exemplary figures. However, the first and second ends of the container may be closed in any order, sequentially or simultaneously.

Figure 3A:
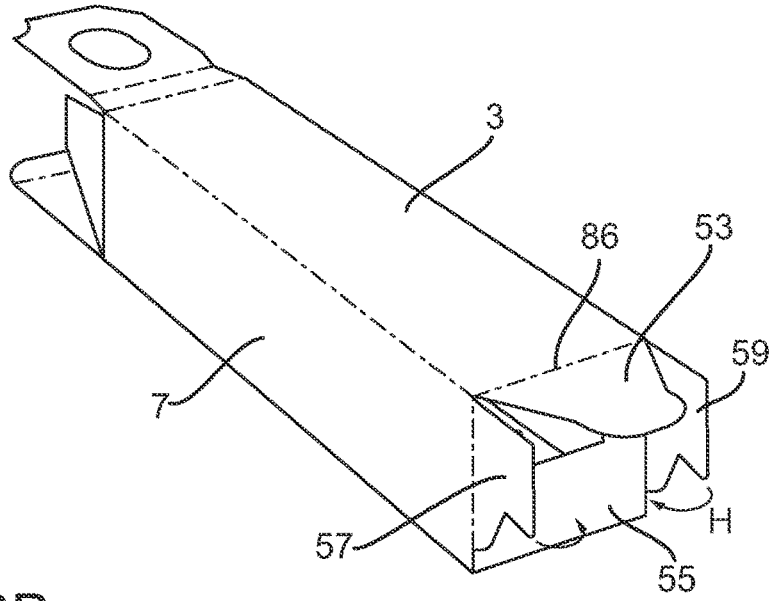
FIG. 3A illustrates a first step in the closure of the base of the container of the erected blank of FIG. 2G in accordance with one embodiment for obtaining the container of FIG. 2H.

In a first step the first base flap 55 associated with the second end of the second outer shell sidewall panel 5 is rotated through 90 degrees (in the direction of arrow G in FIG. 2G) about foldline 80 from the position shown in FIG. 2G to the position shown in FIG. 3A. This causes the first base reinforcement flap 63 connected to the first inner sidewall panel 11, and which underlies the first base flap 55, to simultaneously be rotated around foldline 88.

Figure 3B:
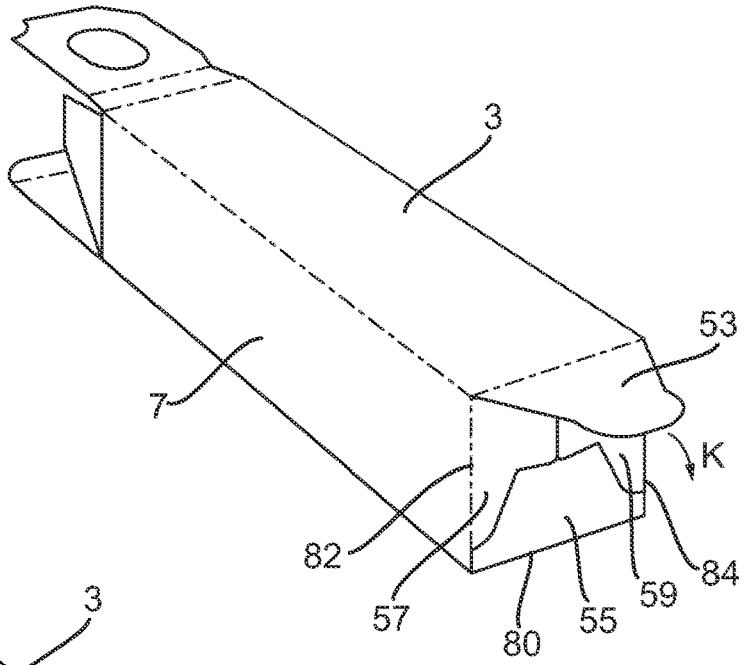
FIG. 3B illustrates a second step in the closure of the base of the container of the erected blank of FIG. 2G in accordance with one embodiment for obtaining the container of FIG. 2H.
Figure 3C:
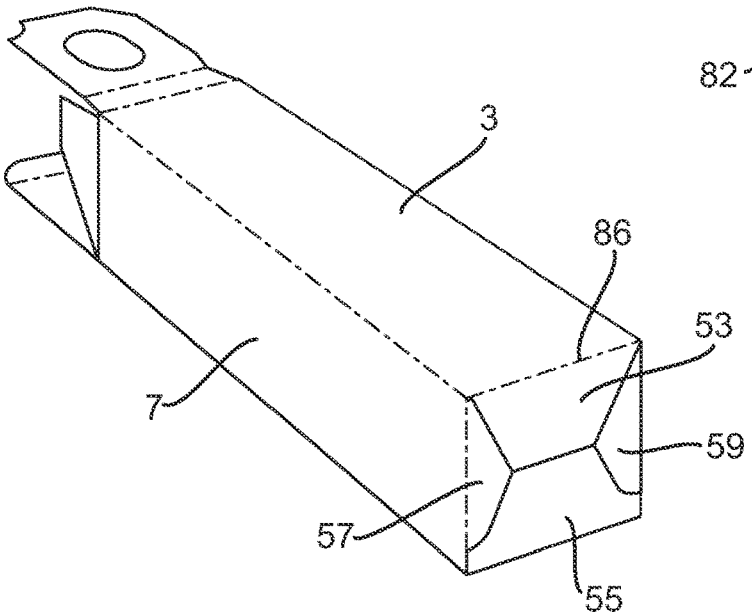
FIG. 3C illustrates a third step in the closure of the base of the container of the erected blank of FIG. 2G in accordance with one embodiment for obtaining the container of FIG. 2H.

In a second step, the second and third base flaps 57, 59 associated with the second ends of the third and fourth outer shell sidewall panels 7, 9 respectively are rotated through 90 degrees about the foldlines 82, 84 (in the direction of arrows H in FIG. 3A) to the position shown in FIG. 3B so as to overlie the first base flap 55.

In a third step the fourth base flap 53 connected to the first outer shell sidewall panel 3 is folded about the foldline 86 (in the direction of arrow K in FIG. 3B) and its distal end portion pushed toward the interior of the container to the position. This causes the second base reinforcement flap 61 connected to the first inner sidewall panel 11, and which underlies the first base flap 55, to simultaneously be rotated around foldline 97, with the distal end portion of the base reinforcement flap 61 being pushed with the distal end portion of the fourth base flap 53 into the interior of the container.

The movement of the fourth base flap 53 and the underlying second base reinforcement flap 61 into the interior of the container pushes the hooks 58, 60 of the distal portions of the second and third base flaps 57, 59 behind the edge 56 defined by the recess at the distal end of the first base flap 55, with the locking tab portion 64 of the fourth base flap 53 (and the distal end portion of the underlying second base reinforcement flap 61) being inserted through a slot thus defined by the edge 56 and the distal portions of the second and third base flaps 57, 59. The distal end 91 of the fourth base flap 53 (and the distal end portion of the underlying second base reinforcement flap 61) is disposed in the interior of the container in the closed base, while the base panel portion 62 forms part of the exterior of the base. In the closed base, the hooks 58, 60 help to prevent movement of the locking tab portion 64 of the fourth base flap 53 (or the distal end portion of the second base reinforcement flap 61) out of the slot once more, and thus helps to avoid the base undesirably coming open when an outwardly directed force is exerted on the interior thereof by a product located in the container.

The resulting closed base resembles the reverse of an envelope, and may be referred to as an "envelope base" closure.

It will be seen that in the embodiment illustrated, the base reinforcement flaps 63, 61 underlie the first and fourth base flaps 55, 53 respectively, providing additional strength to the base.

It will be appreciated that the locking tab portion 62 of the fourth base flap 53 extends through a slot as described in the closed base. The slot may not necessarily exist prior to insertion of the fourth base flap into the interior of the container e.g. if the second and third base flaps comprise distal ends which hook behind the edge 56 of the first base flap 55.

Of course, the closure of the base need not be performed in exactly the manner above-described. For example, the hooks of the second and third base flaps 57, 59 may be engaged behind the edge 56 of the first base panel 55 in a separate step, prior to pushing the distal end portion of the fourth base flap 53 toward the interior of the container. Likewise, the steps of folding and gluing the blank need not be performed as illustrated with respect to FIGS. 2A-G. For example, the order of steps, and/or the lines along which folding occurs may differ. Any suitable methods may be used which result in a container as shown in FIG. 2H, and described further by reference to FIGS. 4A and B.

The shape of the first, second, third and fourth base flaps 53, 55, 57, 59 need not be as shown. For example, the distal portions of the second and third base flaps 57, 59 need not define hooks. The distal portions of the second and third base flaps may include straight side edges which extend along the edge 56 of the first base flap 55 to define the slot through which the distal end portion 91 of the fourth base flap 53 is inserted. Such an arrangement may be provided where the side edge of the distal portion of the base flap extends substantially perpendicular to the end edge of the flap. However, the use of hooks may provide a stronger base construction. Alternatively or additionally, the distal portions 93, 95 of the first base flap 55 need not necessarily define hooks. The opposed inner side edges of the distal portions which provide side edges of the recess in the distal end of the first base flap 55 may be extend parallel to one another. However, the use of hooks may again provide a stronger base construction, helping to retain the second and third base flaps 57, 59 in position in the closed base.

The shapes of the first and second base reinforcement flaps 63, 61 may differ from that shown. For example, the shape of the first base reinforcement flap may correspond to that of the first base flap 55 i.e. including a recess, with the first base reinforcement flap being of smaller area than the first base flap 55 to ensure that it fits within the contour thereof, in a similar manner to the first base reinforcement flap 61 and the fourth base flap 53.

Where hooks are provided on any or all of the second, third or first base flaps, the configuration of the hooks, e.g. the steepness of the angle defined at the distal end thereof, and/or the length of the hooks may be varied as desired. The shape of any of the base flaps may be varied as desired e.g. to provide a base closure of required strength for a given application, provided that the flaps may interact in the manner described.

The first and second base reinforcement flaps 63, 61 may be omitted if desired e.g. if a stronger base construction is not required.

Finally, although an envelope base closure has been described, any suitable method of providing a closed base may be used, which may or may not involve the use of adhesive or other bonding to retain the base in its closed configuration.

In the erected container 200 e.g. as shown in FIG. 2H, the sidewall panels of the inner shell cooperate with respective ones of the outer shell sidewall panels to reinforce the walls of the container. The first, second third and fourth inner shell sidewall panels 11, 13, 15, 17 are in face-to-face contact with the first, second, third and fourth outer shell sidewall panels 3, 5, 7, 9 respectively. In the embodiment illustrated, the inner shell sidewall panels each extend over substantially the entire height of the outer shell sidewall panels. However in other embodiments, it is envisaged that at least some of the panels may extend over less than the full height of the outer shell sidewall panels. In the illustrated embodiment, the first, second and fourth inner shell sidewall panels 11, 13, 17 extend over the full width of the outer shell sidewall panels with which they are in contact. However, the third inner shell sidewall panel 15, which provides a glue panel, extends over less than the full width of the third outer shell sidewall panel 7. In the illustrated embodiment, the panel extends over approximately 90% of the width of the outer shell sidewall panel. In other embodiments, the third inner shell sidewall panel 15 might extend over a different proportion of the width of the third outer shell sidewall panel 7, e.g. up to the full width, and preferably at least 60% of the width to provide effective reinforcement.

The present invention provides a method of strengthening the walls of the container, to provide a double thickness wall, which may be achieved by folding and gluing a single piece blank, and without the need laminate sheets of material together to provide the blank initially, which may undesirably complicate manufacture and assembly.

Figure 4A:
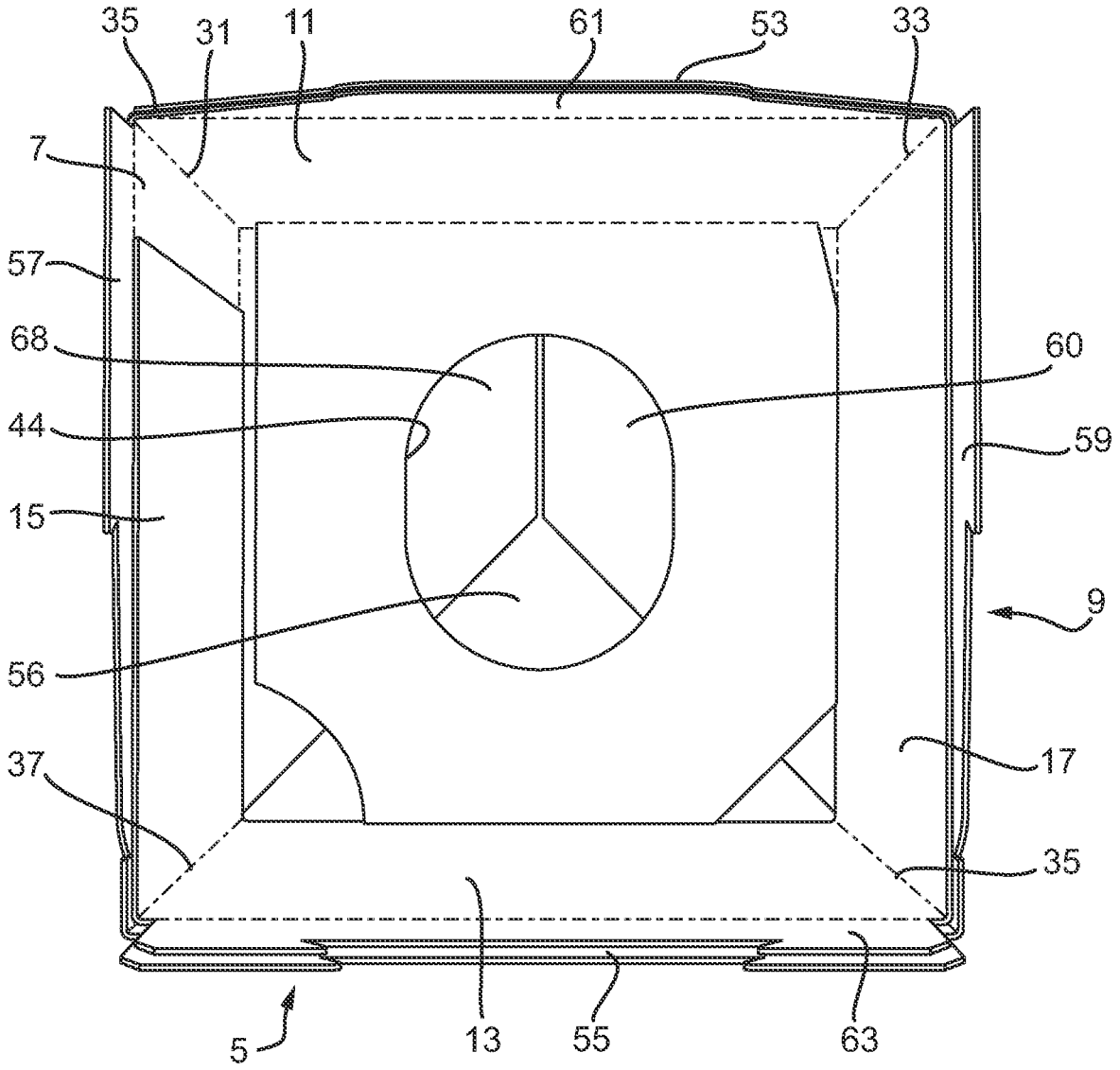
FIG. 4A is a view of the interior of the erected blank of FIG. 2G taken from the second, bottom end prior to closing of the first and second ends of the container.
Figure 4B:
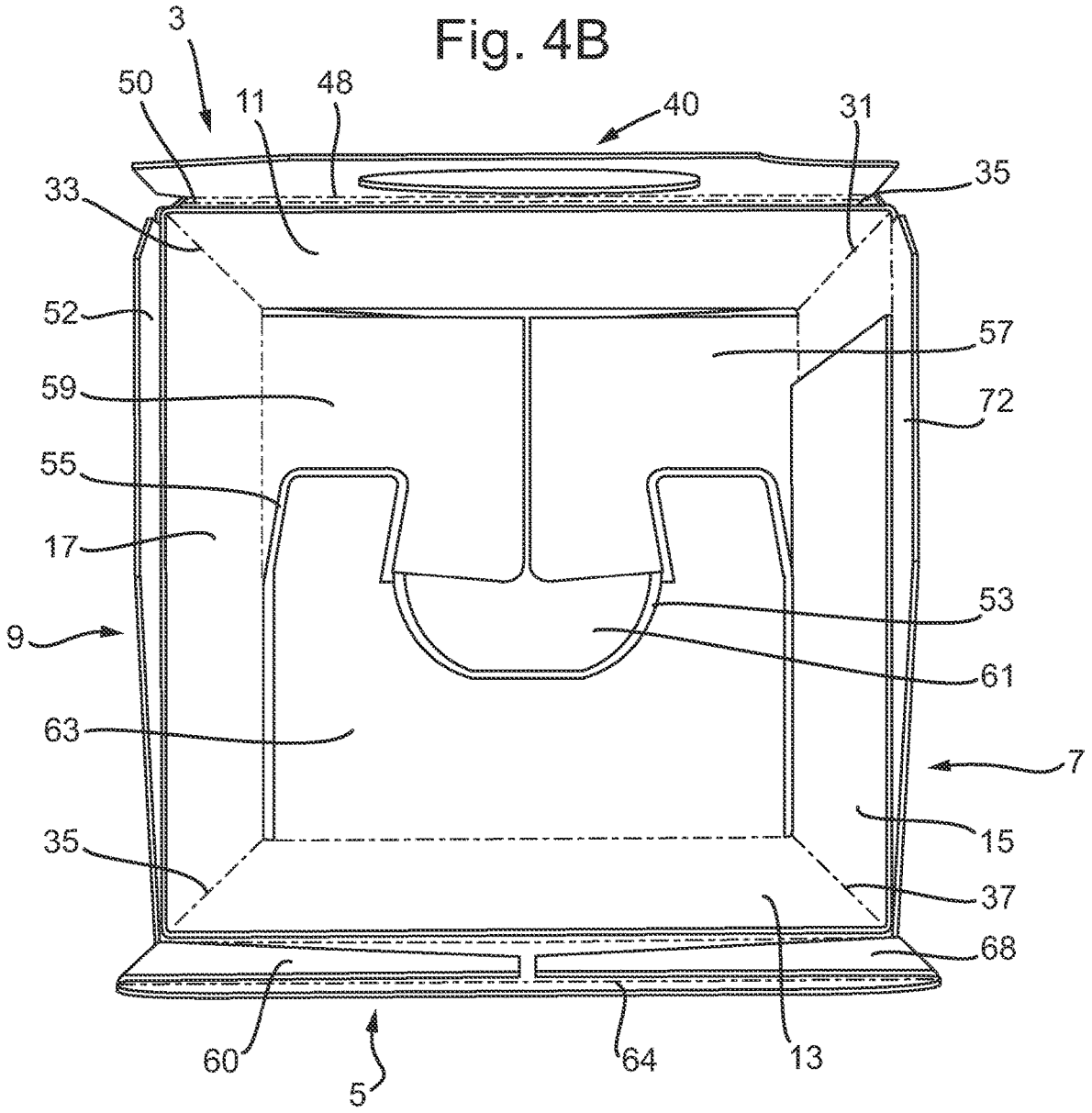
FIG. 4B is a view of the interior of the erected blank of FIG. 2G taken from the first, top end prior to closing of the first and second ends of the container.

Certain features of the erected container 200 will now be described by reference to FIGS. 4A and B. FIG. 4A is a view into the interior of the container through the second end (with the base structure open for the purposes of illustration). FIG. 4B is a view into the interior of the container through the first end (with the lid structure open for the purposes of illustration).

It may be seen that the first inner shell sidewall panel 11 is in face-to-face contact with (and adhered to) the inner surface of the first outer shell sidewall panel 3. The glue flap 35 is sandwiched between the first inner shell sidewall panel 11 and the first outer shell sidewall panel 3. In this way, the presence of a visible raw edge of material is avoided. The user is instead presented with a folded edge. This may be advantageous in providing improved appearance of the container. The outer surface of the outer shell may have a more uniform appearance. For example, where the material of the blank from which the container is erected has a decorative finish e.g. colouring or printing at least on the surface which provides the outer surface of the sidewall panels of the outer shell, the folded edge may then have the same appearance as the remainder of the visible exterior surfaces of the outer shell of the container, e.g. the same colouring etc., rather than being a raw edge. The sandwiching of the glue flap may also provide a neater overall appearance of the container.

The third inner shell sidewall panel 15 is in face-to-face contact with (and adhered to) the third outer shell sidewall panel 7. The second inner shell sidewall panel 13 is in face-to-face contact with (and not adhered to) the inner surface of the second outer shell sidewall panel 5, and the fourth inner shell sidewall panel 17 is in face-to-face contact with (and not adhered to) the fourth outer shell sidewall panel 9. Of course, in other embodiments, the second and fourth inner sidewall panels might be adhered to the second and fourth outer shell sidewall panels respectively.

FIG. 4B shows the way in which the base flaps and base reinforcement flaps interlock to provide the closed base structure. It may be seen that the distal ends of the fourth base flap 53 and the second base reinforcement flap 61 extend through a slot provided by the distal edge regions of the distal portions of the second and third base flaps 57, 59 and the proximal edge 56 of the recess in the first base flap and of the recess in the distal end of the corresponding underlying first base reinforcement flap 63. The distal ends of the fourth base flap 53 and the underlying second reinforcement flap, which are located within the container, provide locking tab portions (the locking tab portion of the fourth base flap 53 being denoted 64). The bases of these locking tab portions are sandwiched between the hooks 58, 60 associated with the second and third base flaps and the region of the first reinforcement flap 63, proximal to the slot defining edge therein. The distal portions 93, 95 of the first base flap 55 and the first reinforcement flap 63 underlie (and are in face-to-face contact with) the second and third base flaps when the base is viewed from the interior as in FIG. 4B, to help secure the second and third base flaps in place, and hence to help inhibit movement of the distal end of the fourth base flap and the second reinforcement flap out of the slot e.g. when a force is applied by a product located in the container, to urge the base outwardly in use.

The first and second reinforcement flaps are in face-to-face contact with their respective base flaps, and are unsecured thereto.

It is envisaged that a reinforcement flap may only be provided in respect of one of the first and fourth base flaps.

This arrangement provides an envelope type base structure, but in which certain flaps i.e. the first and fourth base flaps, are reinforced. Thus, reinforcement is provided for flaps which are particularly important in avoiding failure of the base.

It has thus been recognised that the flaps 61 and 63 connected to the ends of the first inner shell sidewall panel 11 and the second inner shell sidewall panel 13 may be used to reinforce the outer base flaps 53, 55 associated with the second and first outer shell sidewall panels 9, 3. These flaps may be cut from areas of the sheet from which the blank is produced which would otherwise be wasted. This may be achieved without the need to laminate sheets together when forming the blank.

It is envisaged that the reinforcement of base flaps forming part of an envelope base may be of utility in respect of containers other than those of the type illustrated having inner and outer shells of the type described, provided that some suitable arrangement is provided to result in the reinforcement flaps being located appropriately with respect to the base flaps. For example, the container might be formed of multiple pieces, or have some other form of inner shell structure.

While the bonding of various components to one another has been described in relation to an adhesive connection, other bonding technologies may be used e.g. heat sealing etc. An adhesive connection referred to herein may, unless the context demands otherwise, in general be any bonded connection, not limited to adhesive.

It is envisaged that the number of inner and outer shell side wall panels may vary from that illustrated.

All of the assembly steps described by reference to FIGS. 2A-H and 3A-C, including all gluing and folding steps, may be performed in a fully automated manner by a machine.

The containers described herein may be used with any desired product, but are particularly useful in the context of fragile products, such as bottles e.g. drinks bottles. The construction may provide a relatively stronger container for such products, in embodiments, with reduced risk of base failure.

It will be understood that the above description is of a number of exemplary embodiments only and that modifications may be made to the embodiments without departing from the scope of the invention.

The invention claimed is:

1. A single piece container made from cardboard, paperboard or other lightweight foldable sheet material, the container comprising:

an outer shell having a first end and a second end, and comprising a plurality of outer shell sidewall panels hingedly connected to one other about respective outer shell sidewall foldlines, the outer shell sidewall panels extending between the first end and the second end of the outer shell, wherein at least the second end of the outer shell is a closed end;

an inner shell comprising a plurality of inner shell sidewall panels hingedly connected to one other about respective inner shell sidewall foldlines, wherein the inner shell is integrally connected to the outer shell along a foldline;

wherein each one of the inner shell sidewall panels is in face-to-face contact with the inner surface of a respective one of the outer shell sidewall panels;

wherein one of the plurality of outer shell sidewall panels is connected on one side along a foldline to an adjacent one of the plurality of outer shell sidewall panels, and comprises a flap connected thereto along a foldline along its opposite side, wherein the flap is bonded to one of the plurality of inner shell sidewall panels.

2. The container of claim 1 wherein the flap is a glue flap.

3. The container of claim 1 wherein the flap is sandwiched between one of the plurality of outer shell sidewall panels to which it is connected along a foldline and one of the plurality of inner shell sidewall panels which is in face-to-face contact with the one of the plurality of outer shell sidewall panels.

4. The container of claim 1 wherein only some pairs of each of the inner shell side wall panels and the respective outer shell sidewall panels which are in face-to-face contact with one another are bonded to one another.

5. The container of claim 1 wherein one of the plurality of inner shell sidewall panels adjacent another of the plurality of inner shell sidewall panels which is connected along a foldline to one of the plurality of outer shell sidewall panels extends over another of the plurality of outer shell sidewall panels, having a width, with which it is in face-to-face contact, wherein the one of the plurality of inner shell sidewall panels is configured to extend over only a portion of the width of the other of the plurality of outer shell sidewall panels.

6. The container of claim 1 wherein the outer shell comprises first, second, third and fourth outer shell sidewall panels of the plurality of outer shell sidewall panels, wherein the first and second outer shell sidewall panels and the third and fourth outer shell sidewall panels form opposed pairs of outer shell sidewall panels.

7. The container of claim 6 wherein the inner shell comprises first, second, third and fourth inner shell sidewall panels of the plurality of inner sidewall panels, wherein the first inner shell sidewall panel is in face-to-face contact with the first outer shell sidewall panel, the second inner shell sidewall panel is in face-to-face contact with the second outer shell sidewall panel, and the third inner shell sidewall panel is in face-to-face contact with the third outer shell sidewall panel, and the fourth inner shell sidewall panel is in face-to-face contact with the fourth outer shell sidewall panel.

8. The container of claim 1 wherein one or more of the plurality of outer shell sidewall panels comprise a base flap having an area and connected to a second end thereof along a foldline for use in providing a closed base at the second end of the outer shell, and wherein one or more of the plurality of inner shell sidewall panels comprises a reinforcement flap connected to a second end thereof along a foldline, which reinforcement flap is arranged to underlie one of the base flaps of the outer shell to reinforce the outer shell base flap.

9. The container of claim 8 wherein the outer shell comprises first, second, third and fourth outer shell sidewall panels of the plurality of outer shell sidewall panels, and each one of the first, second, third and fourth outer shell sidewall panels comprises a base flap connected to the second end thereof along a foldline to provide a set of base flaps, the base flaps including;

a first base flap connected along a foldline to an outer shell sidewall panel of the plurality of outer shell sidewall panels;

second and third opposed base flaps connected along respective foldlines to respective ones of the plurality of outer shell sidewall panels adjacent the outer shell sidewall panel to which the first base flap is connected on either side thereof, wherein the second and third base flaps are folded over the first base flap;

and a fourth base flap connected along a foldline to an outer shell sidewall panel of the plurality of outer shell sidewall panels opposite the outer shell sidewall panel to which the first base flap is connected, wherein the fourth base flap is folded over the second and third base flaps;

wherein the fourth base flap comprises a base panel portion which forms part of the exterior of the base and a locking tab portion connected to a distal end of the base panel portion, wherein the locking tab portion of the fourth base flap is inserted through a slot defined by the first, second and third base flaps into the interior of the container to retain the base in a closed configuration;

and wherein a reinforcement flap is provided in respect of at least the first and fourth base flaps.

10. The container of claim 8 wherein each reinforcement flap extends over only a portion of an area of the base flap which it reinforces.

11. The container of claim 8 wherein each reinforcement flap is unsecured to the base flap which it reinforces.

12. The container of claim 8 wherein each reinforcement flap is in face-to-face contact with the base flap which it reinforces.

13. A single piece blank erectable to provide a container in accordance with claim 1.

14. The blank of claim 13, wherein the inner shell comprises an edge that is opposite the fold line along which the inner shell is integrally connected to the outer shell, wherein the edge of the inner shell that is opposite the fold line is a free edge.

15. A container made from cardboard, paperboard or other lightweight foldable sheet material, the container comprising:

first, second, third and fourth sidewall panels hingedly connected to one other about respective foldlines, the first, second, third and fourth sidewall panels extending between first and second ends of the container, wherein each one of the first, second, third and fourth sidewall panels comprises a base flap connected to the second end thereof along a foldline to provide a set of base flaps, the set of base flaps including;

a first base flap connected along a foldline to one of the first, second, third and fourth sidewall panels;

second and third opposed base flaps connected along respective foldlines to respective ones of the first, second, third and fourth sidewall panels adjacent the sidewall panel to which the first base flap is connected on either side thereof, wherein the second and third base flaps are folded over the first base flap;

and a fourth base flap connected along a foldline to a sidewall panel of the first, second, third and fourth sidewall panels opposite the sidewall to which the first base flap is connected, wherein the fourth base flap is folded over the second and third base flaps;

wherein the fourth base flap comprises a base panel portion which forms part of the exterior of the base and a locking tab portion connected to a distal end of the base panel portion, wherein the locking tab portion of the fourth base flap is inserted through a slot defined by the first, second and third base flaps into the interior of the container to retain the base in a closed configuration;

wherein the container comprises a reinforcement flap in respect of each of one or more of the base flaps, the reinforcement flap being arranged to underlie a respective one of the base flaps to reinforce the base flap.

16. The container of claim 15 wherein the first, second, third and fourth sidewall panels form an outer shell of the container, and the container further comprises an inner shell comprising a plurality of sidewall panels hingedly connected to one another along respective foldlines, and the reinforcement flaps are connected along foldlines to the second ends of respective ones of the first, second, third and fourth sidewall panels of the inner shell.

17. The container of claim 15 wherein each reinforcement flap extends over only a portion of an area of the base flap which it reinforces.

18. The container of claim 15 wherein each reinforcement flap is unsecured to the base flap which it reinforces.

19. The container of claim 15 wherein each reinforcement flap is in face-to-face contact with the base flap which it reinforces.

20. A single piece blank erectable to provide a container in accordance with claim 15.

* * * * *